United States Patent [19]

Glanzman

[11] 4,208,984

[45] Jun. 24, 1980

[54] RAZOR USAGE INDICATOR

[76] Inventor: Norman Glanzman, 4234 Centennial Ct., Carmel, Ind. 46032

[21] Appl. No.: 950,731

[22] Filed: Oct. 12, 1978

[51] Int. Cl.[2] ..... B26B 21/40; B26B 21/52

[52] U.S. Cl. ..... 116/307; 30/34 A; 116/323; 116/324

[58] Field of Search ..... 116/307, 324, 323, DIG. 6, 116/225, 321; 30/34 A; D28/48; 206/352

[56] References Cited

U.S. PATENT DOCUMENTS

| | | | |
|---|---|---|---|
| 488,736 | 12/1892 | King | 116/323 |
| 791,903 | 6/1905 | Hawkins | 116/324 |
| 1,170,298 | 2/1916 | Lundy | 116/324 |
| 2,750,664 | 6/1956 | Merlo | 30/34 A |
| 2,796,981 | 6/1957 | Reinbrecht | 206/46 |
| 2,812,575 | 11/1957 | Abbot | 30/34 A |
| 2,827,872 | 3/1958 | Thoma | 116/323 |
| 2,885,993 | 5/1959 | Murphy | 116/133 |
| 3,229,659 | 1/1966 | Sciascia | 30/34 A |
| 3,394,456 | 7/1968 | Gatz | 30/90 |
| 3,618,563 | 11/1971 | Singer | 116/133 |

*Primary Examiner*—Gerald Goldberg
*Assistant Examiner*—Denis E. Corr
*Attorney, Agent, or Firm*—Gerald H. Glanzman

[57] ABSTRACT

Apparatus for monitoring razor usage. The apparatus comprises an indicator means supported within a hollow handle portion of the razor and slidable to selected positions along the length thereof for alignment with numbered indicia on the handle to permit monitoring the number of times that the razor has been used.

The apparatus provided may be used with razors of either the reusable or disposable type and can be incorporated into such razors with only minor alteration of the razor design.

3 Claims, 3 Drawing Figures

RAZOR USAGE INDICATOR

BACKGROUND OF THE INVENTION

1. Field of the Invention

The present invention relates generally to an apparatus for monitoring razor usage. More particularly, the present invention relates to an indicator incorporated into the handle of a razor to permit the user to maintain a record of the number of times that a razor blade has been used.

2. Description of the Prior Art

A razor incorporating structure to enable one to monitor the number of times that a blade has been used would be a desirable product for several reasons. For one thing, it would permit the user to comparison shop more effectively by enabling him to determine which type or brand of blade provides him with the greatest number of confortable shaves. In addition, it would provide him with advanced warning that a particular blade is nearing the end of its life span. With this knowledge, he would known when to have a replacement available, and also can avoid the uncomfortable and sometimes painful experience of shaving with a dull, worn-out blade.

With the recent introduction and rapid growth in popularity of the disposable razor (or razor having a permanently attached blade that is replaced in its entirety when the blade wears out), means for monitoring blade usage becomes even more desirable. This is because disposable razors are somewhat more expensive than replacement blades, and, thus, comparison shopping can result in a more meaningful savings. Also, because the user tends to keep only one or two of these razors on hand at any given time, it becomes more useful for him to known when a replacement should be purchased.

Notwithstanding the desirability of providing means to indicate blade usage, it is clear that for such a feature to be commercially acceptable, it must not appreciably increase the price of the razor. For this reason, many of the blade usage indicators that have previously been developed and that are taught in the prior art are simply not acceptable. For example, U.S. Pat. No. 2,750,664 illustrates a razor having a rotatable disc attached to the top of the handle; U.S. Pat. No. 3,394,456 describes a rotatable counter built into a protective cover of the razor; and U.S. Pat. Nos. 2,812,575; 2,885,993; 3,229,659; and 3,618,563; all teach counters in the form of sleeves or discs which are rotatable relative to the handle of a razor. Each of the designs illustrated in these patents are quite complex and most would make the cost of the razor, especially a disposable razor, prohibitive. Also, many of them would require substantial redesign of the over-all razor construction making them unsuitable for incorporation into existing razor designs.

SUMMARY OF THE PREFERRED EMBODIMENTS

In accordance with the present invention, an apparatus for monitoring razor blade usage is provided which avoids the prior art inadequacies described above. In particular, the monitoring apparatus of the present invention can readily be incorporated into many of the existing razor designs, either of the reusable or disposable type, without requiring significant modification and without appreciably adding to the cost of manufacturing the razor.

In accordance with a presently most preferred embodiment, the monitoring apparatus is in the form of a slider mounted within the hollow handle of the razor and having a pointer means extending through a longitudinal slot molded into a wall of the handle. Indicia is preferably provided on the handle along the length of the slot so that by merely moving the slider along the length of the handle each time the razor is used to align the pointer with the appropriate indicia on the handle, it becomes a simple matter to monitor blade usage.

According to one embodiment, the slider is mounted on a track built into the handle and is adapted to be maintained in alignment with the appropriate indicia by friction. In accordance with an alternative embodiment, the indicia are in the form of shallow grooves, and spring means are provided within the handle to hold the slider in position by maintaining the pointer within the appropriate groove.

Either of the above described embodiments can be readily incorporated into many of the razors presently on the market with only minor redesign of the razor handle, and neither will significantly increase the cost of the razor.

Further details and features of the invention will be set out hereinafter in conjunction with the detailed description of the preferred embodiments.

BRIEF DESCRIPTION OF THE DRAWINGS

FIG. illustrates a razor incorporating a razor blade usage monitoring apparatus according to a presently most preferred embodiment of the invention.

DETAILED DESCRIPTION OF THE PREFERRED EMBODIMENTS

Figure 1:
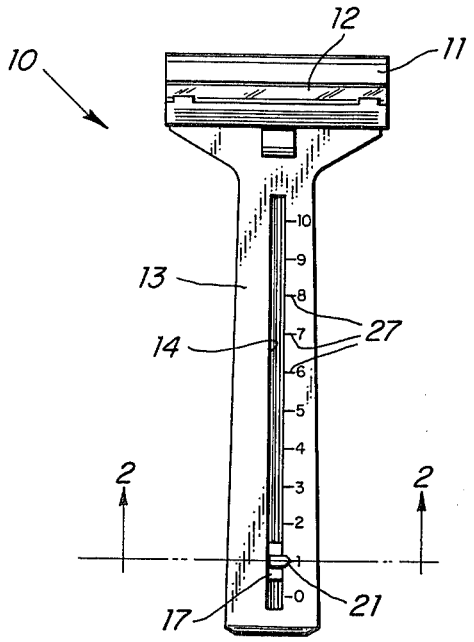

FIG. 1 illustrates a razor incorporating the blade usage monitoring apparatus according to a presently most preferred embodiment of the invention. The razor, generally identified by reference number 10, includes a blade supporting portion 11 adapted to hold a blade 12 of any known type, and a handle portion 13. Razor 10, illustrated in FIG. 1, is of the disposable type (although it should be understood that the invention should not be limited to this type of razor), and, conventionally, the handle and at least a portion of the blade supporting portion are manufactured from a single piece of molded plastic. Additionally, in most of the brands presently on the market, the handle portion is at least partially hollow and some are further provided with a slot extending along the length of the handle. As will become apparent hereinafter, the blade usage monitoring apparatus of the present invention can be incorporated into these particular razors with almost no razor design modifications being necessary, while for most othe razors, only minor design changes would be needed.

Figure 2:
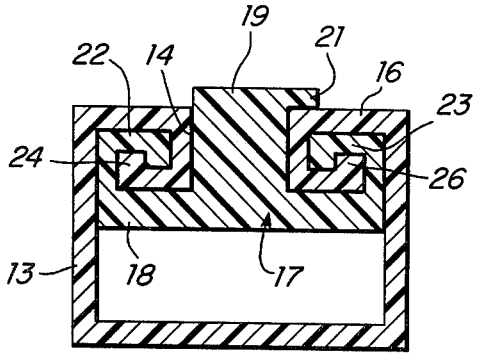
FIG. 2 illustrates a cross-sectional view of the razor of FIG. 1 looking in the direction of arrows 2—2 in FIG. 1.

In particular, and as illustrated in FIGS. 1 and 2, handle 13 is hollow and generally rectangular in shape, and is provided with a longitudinal slot 14 in one wall 16 thereof extending substantially along the entire length of the handle. Positioned within handle 13 is an indicator means in the form of a slider generally designated by reference number 17. Slider 17 is preferably also constructed of plastic and includes a body portion 18 positioned within the handle and a neck portion 19 extending through the slot 14 in the handle 13. Formed from the end of neck portion 19 is a pointer 21 in the form of a small arrow or the like, more clearly seen in FIG. 1.

As illustrated in FIG. 2, body portion 18 of slider 17 is provided with a pair of arm portions 22 and 23 which are adapted to be supported on a pair of guides or tracks 24 and 26, respectively, formed by extending wall 16 of the handle to protrude into the interior space of the handle as shown. Tracks 24 and 26 extend along the entire length of slot 14, and are designed to hold the slider in position at any location along the track by friction while, at the same time, allowing the slider to be easily moved to any location along the slot by merely pushing neck portion 19 with a finger.

As illustrated in FIG. 1, numbered indicia 27 is provided on the handle along the length of the slot, and, by merely advancing the slider by one unit each time that the razor is used, it becomes a simple matter to maintain a count of the number of times that the blades has been used.

Although in FIG. 1, only 10 markings are illustrated, this had been done for purposes of clarity only. In practice, 20 or more markings can easily be placed on the handle.

Figure 3:
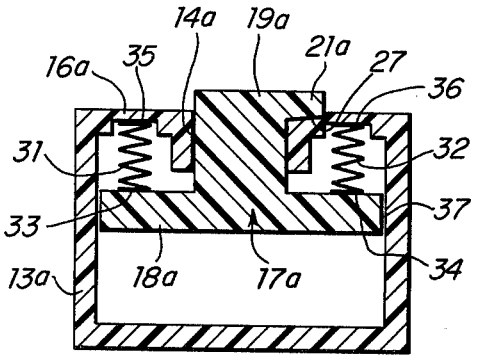
FIG. 3 illustrates a cross-sectional view of an alternative embodiment of the present invention.

FIG. 3 illustrates an alternative embodiment of the invention. In FIG. 3, the tracks 24 and 26 have been eliminated, and, instead, the slider 17*a* is supported in the interior space of the holow handle 13*a* by means of pointer portion 21*a* extending from neck portion 19*a* and pressing against wall 16*a*. In this embodiment, a pair of springs 31 and 32 are provided (although coil springs are illustrated in the FIG., leaf springs or other spring means may also be employed). One end of each of the springs 31 and 32 is attached to body portion 18*a* of slider 17*a* at locatins 33 and 34, respectively, while the opposite ends of springs 31 and 32 are adapted to press against guides in the form of troughs 35 and 36 formed in wall 16*a* which also protrudes into the interior space of the handle and extending along the length of the slot 14*a*.

Springs 31 and 32 are maintained under a slight compression so as to push body portion 18*a* of slider 17*a* downwardly in FIG. 3 to, in turn, push pointer 21*a* against the wall 16*a* of the handle to maintain the slider in position. Additionally, as shown in FIG. 3, indicia 27 is preferably in the form of shallow grooves shaped and sized to receive pointer 21*a* so as to positively hold the pointer in the proper position and to avoid accidental movement of the slider. Also, as shown in FIG. 3, body portion 18*a* is positioned within the handle with a slight positive clearance fit such that a slight gap 37 exists between body portion 18*a* and the side walls of the handle. This ensures free moement of the slider along the length of the handle.

In the embodiment of FIG. 3, the slider can be easily indexed along the length of the slot each time the blade is used, and yet will be firmly held in the desired position against accidental movement by the positive action of springs 31 and 32 maintaining pointer 21*a* in the grooved indicia lines 27.

While what has been described are presently most preferred embodiments, it should be clearly understood that many additions and modifications could be made without departing from the invention. For example, the grooved indicia lines and the positive clearance fit, illustrated in FIG. 3, could readily be incorporated into the embodiment of FIGS. 1 and 2, if desired. Also, either embodiment may be designed to incorporate structure to permit the slider to be moved in one direction only, if desired. Additionally, either embodiment may be modified to place the numbered indicia on the movable slider while providing the pointer or arrow on the handle such that movement of the slider will align the appropriate number with the stationary pointer. Finally, it should be apparent that a variety of other designs could be employed to move and support the slider within the handle.

Because the invention can take many other forms, it should be understood that the invention should be limited only insofar as required by the scope of the following claims.

I claim:

1. A razor including a blade supporting portion and a handle portion, said handle portion being at least partially hollow with an interior space and comprising:
   a. a longitudinal slot extending through a wall thereof;
   b. indicia means located at various positions along at least a portion of the length of said slot;
   c. indicator means movable along the length of said slot, said indicator means including:
      i. a body portion positioned within said at least partially hollow handle portion;
      ii. a neck portion coupled to said body portion and extending through said slot; and
      iii. a pointer portion coupled to said neck portion, said indicator means being movable along the length of said slot to selectively align said pointer portion with said indicia means; and
   d. guide means protruding into said interior space within said at least partially hollow handle portion, said body portion of said indicator means being slidably movable along said guide means to selectively align said pointer portion with said indicia means.

2. A razor as recited in claim 1 and further including spring means positioned within said handle portion between said body portion and said guide means, said spring means biasing said pointer portion for maintaining said pointer portion is alignment with a selected one of said indicia means.

3. A razor a recited in claim 1 wherein said indicia means comprises a plurality of numbered indicia, each of said plurality of numbered indicia having spaced groove means adjacent thereto, each of said groove means being shaped to receive said pointer portion to help maintain said pointer portion in alignment with a selected on of said groove means.

* * * * *